US007988511B2

(12) United States Patent
Bissell, IV et al.

(10) Patent No.: US 7,988,511 B2
(45) Date of Patent: Aug. 2, 2011

(54) FREEDIVING SAFETY APPARATUS

(75) Inventors: Henry M. (Chip) Bissell, IV, Oak View, CA (US); Sheri Gayle Daye, Boca Raton, FL (US); Terry L. Maas, Ventura, CA (US); Jason R. Bush, Oakland, CA (US); David Sipperly, Wakefield, RI (US); Peter Madnick, Ventura, CA (US); Kenneth J. Samel, Irvine, CA (US); Robert Fairchild, Santa Ana, CA (US)

(73) Assignee: Oceanic Safety Systems LLC, Ventura, CA (US)

( * ) Notice: Subject to any disclaimer, the term of this patent is extended or adjusted under 35 U.S.C. 154(b) by 67 days.

(21) Appl. No.: 11/992,509

(22) PCT Filed: Sep. 28, 2006

(86) PCT No.: PCT/US2006/038592

§ 371 (c)(1),
(2), (4) Date: Mar. 9, 2010

(87) PCT Pub. No.: WO2007/038794

PCT Pub. Date: Apr. 5, 2007

(65) Prior Publication Data

US 2010/0167608 A1 Jul. 1, 2010

Related U.S. Application Data

(60) Provisional application No. 60/722,883, filed on Sep. 29, 2005.

(51) Int. Cl.
*B63C 9/00* (2006.01)

(52) U.S. Cl. ..... 441/96

(58) Field of Classification Search ..... 441/88, 441/89, 90, 92, 96, 99, 106, 108, 111–116
See application file for complete search history.

(56) References Cited

U.S. PATENT DOCUMENTS

| | | | | |
|---|---|---|---|---|
| 3,090,205 | A * | 5/1963 | Hurwitz et al. | 405/186 |
| 4,137,585 | A * | 2/1979 | Wright, III | 405/193 |
| 5,800,228 | A * | 9/1998 | Hernandez | 441/94 |
| 6,843,694 | B2 * | 1/2005 | Simmons | 441/89 |

FOREIGN PATENT DOCUMENTS

WO WO 2005035356 A1 * 4/2005

* cited by examiner

*Primary Examiner* — Daniel Venne
(74) *Attorney, Agent, or Firm* — Henry M (Chip) Bissell, IV

(57) ABSTRACT

An apparatus for use in the activity of freediving, providing the freediver with increased safety and protection in the event of Shallow Water Blackout, incapacitating hypoxia, or other emergency occurring in or under the water, while providing greater reliability of functioning, and comfort of wearing during the activity of freediving.

8 Claims, 9 Drawing Sheets

FREEDIVING SAFETY APPARATUS

BACKGROUND OF THE INVENTION

1. Field of the Invention

The present invention generally relates to life-saving equipment used by swimmers and underwater breath-hold divers and, more particularly, to devices and apparatus for use by freedivers* to aid in returning them to the surface and/or maintaining them at the surface in the event of their losing consciousness due to hypoxia, a phenomenon often referred to among freedivers as "Shallow Water Blackout" (SWB). Without some form of rapid and immediate rescue effort, Shallow Water Blackout usually results in death. (*Freedivers are those individuals who venture underwater while holding their breath, and must therefore return to the surface to breathe.)

2. Description of the Related Art

Every year well-trained freedivers, who know the risks of Shallow Water Blackout (SWB), die at an alarming and almost predictable rate. All divers know to jettison their weight belts in an emergency situation. Yet, despite this knowledge, most SWB victims are found on the bottom with their (potentially) life saving weight belts still securely buckled in place.

The reasons behind this counterintuitive fact have been elusive. A recent global poll of freedivers revealed that the population of freedivers is greater than had been thought, and in conjunction, that deaths from SWB are greater as well.

Below is a table presenting the data gathered by this poll. As the data was collected and tallied, a trend began to emerge; that those who freedive in clearer waters are more apt to experience death from SWB.

| COUNTRY | FREEDIVERS | SWB DEATHS/YEAR |
|---|---|---|
| United States- Continental | 10,000 | 3 |
| United States- Hawaii | 5,000 | 6 |
| Greece | 50,000 | 6 |
| Australia | 15,000 | 10 |
| Italy | 12,500 | 12 |
| Portugal | 3,000 | 3-5 |
| New Zealand | 1,000 | 2 |
| South Africa | 8,500 | 0-1 |
| France | 100,000-300,000 | 8-10* *(In 2003, 33 French freedivers died from SWB) |

The reason or reasons behind the all-to-frequent occurrence of SWB among experienced freedivers has, until recently, defied rational explanation. However, greater attention and careful scrutiny of the physiology and psychology of freedivers have yielded valuable insight.

Trained freedivers become adept at ignoring their desire to breathe. In addition, freedivers often are intensely focused and concentrating on a goal, be it depth, duration, or the pursuit of game. Add to this the hesitation experienced by many divers when faced with deciding whether to jettison their weight belt, and potentially ruin a day's diving, or to wait just a bit longer.

Through their having made thousands of successful freedives, some freedivers become over confident, especially under the influence of increasing hypoxia. One, some, or all of these factors can combine to cause a diver, who did not intend this freedive to be his last, to succumb to the often lethal effects of Shallow Water Blackout.

Human physiology changes day-by-day and minute-by-minute. What the experienced freediver has grown accustomed to as normal, may simply be beyond his/her ability to survive in special instances. In some cases, blackout occurs without warning. In other cases, the severely hypoxic freediver is incapable of operating his weight-belt quick-release mechanism. It is theorized that as the freediver approaches the end of a dive, there occurs a profound shift in their psychology, i.e., the freediver simply can no longer rely on their "internal clock" or whatever physiological/psychological mechanism it is that tells them it is time to ascend to safety. As a result, the freediver misperceives his remaining time underwater, and ventures unknowingly closer to unconsciousness due to SWB.

Shallow Water Blackout does not often come on gradually. Rather, the freediver often experiences a sudden "lights out", and falls unconscious. Once unconscious, the opportunities for successful rescue diminish rapidly as minutes pass.

Others have attempted to reduce the risk of SWB through the use of inflatable belts, vests, or harnesses that could be inflated by a carbon-dioxide ($CO_2$) filled cylinder in case of emergency. Some have gone so far as to connect a spring driven or mechanical timer to an inflatable buoyancy device. The timer would be activated by the freediver upon descent, and would count down during the dive. When the timer reached its end, it would activate the emergency inflation of the buoyancy device. Upon surfacing prior to the timed period elapsing, the freediver could reset the timer for the next dive, thereby providing some measure of protection against SWB.

These prior attempts have all incorporated mechanical timers of one form or another. Regardless of form, these timers were all relatively constant with regard to the timed period. That is, they possessed little, if any, ability to vary the period of time elapsed. And none presented the individual end user/freediver with the ability to easily and reliably customize the time interval to reflect their own capabilities.

Despite the immediate appeal of such devices, all they could do is provide the freediver with a false sense of security, in that all prior approaches to the problem of SWB have failed to realistically examine the variety of circumstances under which it occurs.

None of the prior devices address the fact that, once unconscious, the freediver frequently begins to sink into the depths. By the time a mechanical timer has run out, the freediver is often too deep for the $CO_2$ cylinders to inflate the buoyancy device sufficiently to return the freediver to the surface. Boyle's law states that, for any gas at a constant temperature, the volume will vary inversely with the absolute pressure, while the density will very directly with the absolute pressure.

A simple application of Boyle's law to these circumstances reveals that, as a freediver descends underwater, the absolute pressure increases, and the volume of gas available for emergency release from a $CO_2$ cylinder decreases. While the $CO_2$ cylinder's volume might have been sufficient at the surface or near-surface depths, it often proves alarmingly incapable of lifting an unconscious freediver from depth.

In addition, while manual activation of an inflatable device is desirable in an emergency, all of the prior attempts have utilized $CO_2$ cylinders, which are not refillable by the user. The not insignificant cost of these disposable cylinders raises the operating cost of the device, and thereby creates a disincentive for the freediver to deploy it. In addition, $CO_2$ inflation devices are mechanical and are highly prone to corrosion problems. If the inflation device's cylinder cap piercing pin is allowed to become rusted, blunted, or if the $CO_2$ pressure cap is unusually thick, these devices will not function properly in an emergency.

SUMMARY OF THE INVENTION

The flaws described above and other deficiencies inherent in previous attempts to reduce the danger of Shallow Water Blackout, combined with the fact that freedivers have, so far, refused to adopt any of the products that have been introduced, has led to the development of this unique and revolutionary device.

The proposed freediving safety apparatus of the present invention provides the freediver with a customized emergency flotation device that will automatically inflate under a number of life-threatening circumstances. If the freediver stays down beyond his personal limit, or descends to an unsafe depth, the device will inflate and quickly return him to the surface in a up position. If the freediver decides to manually activate the device, presumably in an emergency situation, he may easily do so. The freediver may not deactivate the apparatus unless he is at or near the surface.

The safety apparatus has an inflatable buoyancy portion, an inflation source, an actuator portion for enabling inflation of the buoyancy portion, and a control unit for activating the actuator portion under appropriate, predetermined circumstances.

When worn during the regular course of freediving, the safety apparatus is sleek, stylish, and streamlined. The wearer can move through the water unhindered by, and possibly even unaware of its presence.

The appearance of the apparatus may take the form of a harness or garment similar to a vest, a sleeved shirt, a pair of suspenders, or even a horse collar type or other arrangement. A variety of straps, zippers, hook-and-loop type fasteners, snaps, clips, and similar connectors may be used to secure the apparatus on the freediver. The apparatus must be adequately secure in order to preclude its rising up, or slipping off, the wearer during an emergency ascent.

The buoyancy portion may consist of one or more inflatable bladders or chambers, positioned so as to aid in bringing an unconscious freediver to the surface in a face-up position. Ample buoyancy should be provided in the chest area, as well as adequate support for the head and neck.

It is important that the apparatus deliver the freediver to the surface in a face-up, as opposed to face-down, position. In order to have a better chance of recovery, an unconscious freediver must be in a face-up position. If the freediver is to survive, they must be able to draw a breath of air—thus the necessity of being face-up at the surface. If an unconscious freediver is face-down, it will matter little that he has been brought to the surface.

The buoyancy portion is readily able to be stored in, or retained by, retention or storage devices, such as envelopes, sleeves, or comparable arrangements in order to streamline the apparatus, thereby reducing drag and increasing wearability. While any number of materials can be used for the purpose, stretchable, flexible, and elastic materials like lycra or neoprene are more appropriate for constructing the storage arrangements for the buoyancy portion. If desired, hook-and-loop fastener materials could be used to help retain the buoyancy portion in its storage configuration.

In its stored configuration, the apparatus may be made a nondescript color such as black, or even camouflage, in order not to interfere with a freediver's hunting.

The buoyancy portion may consist of a single or multiple, even redundant buoyancy bladders or chambers in order to provide effective lift and increased fail-safe reliability. In its inflated state, the buoyancy portion may provide additional benefit from materials of highly visible color or pattern, such as bright yellow or orange, to announce the freediver's position and emergency status.

The apparatus may also be equipped with a packet or capsule of colored dye or other signaling medium, which would be released either in conjunction with the apparatus's activation or shortly thereafter. It is desirable that the freediver's position be made as readily apparent as possible. Visible signals, such as the inflated buoyancy portion, the release of dye markers at or near the surface, or other similar methods can be complemented by the incorporation of an audible alert system into the design of the apparatus. Battery powered beepers or similar can be activated by the control unit upon apparatus activation or shortly thereafter.

Such signaling methods may be incorporated into the device to, once at the surface, transmit a signal that could be received by a nearby receiver. This receiver could be the units of other users, or perhaps located aboard a diving vessel, thereby notifying potential rescuers. Or in the event of an emergency, an operator of a vessel could activate a transmitter that could signal all users in the nearby water.

Once the control unit signals the activator to release the compressed gas into the buoyancy portion, the buoyancy portion of the apparatus inflates and rapidly deploys from its storage envelopes to rush the freediver to the surface. The buoyancy portions may be constructed to selectively expand away from the freediver, in order not to apply compression forces to their body. Stretchable materials may be used to achieve this goal, as may a variety of construction methods including panels, pleats, etcetera.

Over-pressure valve or valves may be used to release excess air from the buoyancy portion and thereby prevent over-filling. A manual dump valve may be incorporated in buoyancy portion to allow easy and rapid deflation as desired, thereby also permitting re-packing of the apparatus for re-use.

A significant advantage provided by this safety apparatus is its reusability. The buoyancy portion may be repacked within the storage and retention devices, and the inflation source refilled. The actuator and control unit may be reset, and the apparatus is once again ready for use.

The inflation source may take a variety of forms. One preferred form is that of a small cylinder for compressed air. Single or multiple cylinders may be used. Resembling a miniature SCUBA tank, such a cylinder may be utilized to allow the advantage of being able to recharge the device from a regular SCUBA tank. This ability to easily and conveniently refill the inflation source greatly increases the likelihood that a freediver will elect to manually activate the apparatus in an emergency situation, rather than demonstrate reluctance because of costly replacement $CO_2$ cylinders required by the prior art.

The program logic of the device processes data from high pressure sensors to determine the pressure of the compressed gas inflation source. This pressure value, along with the known capacity of the inflation source, or tank, is used to determine a maximum depth for which operation of the device will be permitted. If for some reason, the inflation source is not fully refilled to capacity, the reduced pressure will be translated into a reduction in the availably buoyancy for emergency inflation. The logic controls of the apparatus may be programmed to calculate, or use a look-up table, to determine the maximum depth at which adequate buoyancy will be available (with perhaps a margin of safety added). The control unit will then reduce the maximum depth allowed as a depth limit (or trigger depth) that may be selected by a user.

Similarly, the inflation source may be outfitted with a mouthpiece, tube, or comparable device, to permit the freediver to orally inflate the apparatus. This feature would permit a freediver to orally inflate the apparatus in the event that they desire the benefit of additional buoyancy, and serves as an alternate inflation method.

The actuator portion is situated between the inflation source and the buoyancy portion of the safety apparatus, and is adapted to direct the flow of the inflation source contents to the buoyancy portion. The actuator portion may be equipped with a valve mechanism, a stopper, or other methods of retaining the contents of the inflation source. In addition, the actuator portion can provide a connector appropriate to attach to a SCUBA tank and permit refilling of the inflation source.

The inflation source may be mounted directly to the actuator portion, or at a distance, connected by an appropriate hose or manifold. In one configuration, the actuator portion mounts directly to the inflation source. In another arrangement, the actuator is positioned alongside the inflation source, and the two are connected by a manifold or hose.

The control unit may be mounted in a wide variety of locations. One possible arrangement has the control unit located on the freediver's chest. Another arrangement has the control unit adapted for mounting on the freediver's wrist or arm, similar to a watch or data console.

The control unit conducts internal polling of the different components of the apparatus in order to ensure the apparatus's ability to function properly. Thorough verification of the apparatus's readiness is essential, and if the internal polling reveals a component or feature that does not check out, i.e., exceeds operational parameter limits, then the control unit is programmed to signal the user through a combination of associated alarms, displays, or even lock-outs to prevent the device from being used in a dysfunctional state.

As an example, if the control unit detects that power supply for the actuator portion is inadequate to ensure the safe functioning of the apparatus, then the control unit could communicate the low power condition through a message on an LCD display, an illuminated LED, or an audible beeping. In addition, if the control unit detects a situation other than fully operational, then the control unit is capable of entering a locked mode to prevent use of a malfunctioning apparatus.

Should a freediver persist in attempting to use the apparatus while diving, the control unit can be programmed to prevent such action. One example would be a situation where a freediver attempts to continue diving even though the control unit has indicated that the pressure inside the inflation source is insufficient to provide adequate inflation of the buoyancy portion in an emergency. If the freediver persists in wearing the apparatus and enters the water, the control unit can be programmed to trigger the inflation of the apparatus at a very shallow depth, thereby preventing the freediver from continuing to dive with a false sense of security. Similarly, this auto-inflation upon initiation of a dive may be used by the device to prevent a user from attempting to continue diving under circumstances in which the device indicates a deficiency or error.

The control unit communicates with the actuator portion, providing the necessary monitoring of potentially triggering variables and other necessary signals. Such means for communication may be achieved through a waterproof direct connection or, preferably, wirelessly. Radio frequency transmitters and receivers, or even infra red units, may be used to enable communication between the control unit and the other portions of the apparatus. The control unit gathers data from various sources and monitors for the occurrence of conditions which require triggering of the actuator portion and release of the contents of the inflation source.

The control unit gathers signals from a variety of sensors. The type and number of sensors is determined by the conditions under which the apparatus is intended to operate. Time, depth, inflation source pressure, power supply condition (e.g., battery charge level), blood oxygen saturation level, pulse rate, and more, are all potentially useful candidates for selected parameters or variables.

Sensors may be located within the control unit, within the actuator portion, or at other remote locations convenient to a particular arrangement of the apparatus. Sensors and associated control units may be located in more than one location, in order to provide redundancy of operation or to simplify presentation or availability of data. The sensors are preferably electronic and solid state, although mechanical sensors may be used.

One embodiment has the control unit contain a control processor unit, which gathers and analyzes the output from the various sensors. The control processor unit compares the sensor outputs to a set or sets of preprogrammed values. Depending upon the algorithms used by the control processor and the sensor outputs received, the control unit determines when and whether to trigger inflation of the apparatus, to enter a lock-out mode, or to remain on stand-by. One or more memory chips or other data storage devices are used as memory to allow storage of, and access to, logic and control instructions, programming, entered data values, sampled data values, dive history data, service information, diagnostic information, error codes, and other user or apparatus data.

The control unit may be configured to accept input from the user. A variety of buttons, switches, touch screen, or other means for interfacing with a user may be incorporated. This provides each user/freediver with the ability to customize their own apparatus to accurately reflect their individual diving capabilities. For example, user-selected values, or individualized settings, for maximum elapsed time and maximum depth may be designated, entered, selected, or changed by the user. As the user desires, perhaps with changing diving conditions or personal preference, the selected individualized values (user-selected values) may be changed repeatedly throughout the day, or as often or infrequently as wished.

In order to ensure reliability, multiple redundant systems are incorporated into the construction of the apparatus wherever possible. It is desirable for the actuator portion and the buoyancy portion to be engineered and constructed with redundant fail-safe mechanisms. The actuator portion should be, in essence, two actuator systems in one unit. Redundant watertight compartments, power supplies, actuation valves, control units, electronics, sensors, and communications systems may be incorporated to provide a high level of redundancy and ensure operability despite failure of significant components. The buoyancy portion may also consist of two systems. In this manner, even if one system were to fail, the back-up unit would be activated, and the apparatus would still function as needed.

The safety apparatus of the present invention may be—programmed by each freediver to reflect their maximum desired safe operating conditions. In so doing, the danger of a "one size fits all" solution is avoided. By programming each device to reflect the diving capabilities and limits of its wearer, the present invention provides the maximum degree of protection available.

This safety apparatus will automatically begin its preprogrammed time countdown, when it detects that the freediver has descended. Throughout the dive, the apparatus monitors the elapsed dive time and maximum depth. The timer count down continues even as the freediver returns to the surface. It is not uncommon for freedivers to be disoriented or even lose consciousness despite being back at the surface and breathing. For this reason, the apparatus will continue with its countdown until the freediver manually resets the device using a provided disarming means. In a preferred embodiment, this disarming means is provided by a magnetic trigger and corresponding sensor. The trigger may be located in the remote mounted control unit, perhaps worn on the wrist of a user. The corresponding deactivation sensor may be located in a variety of places, but it is preferred to incorporate it into the wearable harness or garment portion of the device for ease of use. In order to disable the device and signal a safe return to the surface, a user must bring the trigger into close proximity of the deactivation sensor. If the deactivation sensor is affixed in the shoulder, arm, or chest area of the apparatus, a user would be required to bring the wrist mounted control unit close to or in contact with the deactivation sensor in order to prevent automatic inflation of the device, and to reset the device for another dive.

The freediver is locked out from prematurely disarming the device, unless and until they have returned to the surface. This feature precludes a freediver from prematurely disarming the device while underwater. However, manually activated emergency inflation of the unit while underwater or at the surface is available to a user, and may be achieved by depressing a predetermined button for an interval of time, or combination of buttons.

Should a freediver begin to approach any of the preset limits of this apparatus, a warning will be given for a period of time, in attempt to gain the freediver's attention prior to automatic inflation. Such warning can take various, and even multiple forms. For example, constant or flashing lights, LEDs, or LCD displayed messages, audible tones, or vibrating pulses are just some of the possibilities.

In addition to elapsed dive time and maximum depth as variables or parameters which may trigger automatic inflation, a variety of other variables or parameters may be monitored and selected as potential triggers. For example, oximetry (measuring of blood oxygen saturation) levels or rate of change of those levels, could be used to activate inflation. A measuring probe could be attached to the freediver's finger inside a glove, or attached to the ear, the nose (preferably the ala of the nose) inside the mask, or measurement could occur at other locations. The freediver's pulse could be monitored, and its rate or rate of change could be used as a trigger.

The present invention provides for the use of refillable compressed air containers, rather than expensive disposable $CO_2$ cylinders. Preferably these are small, readily available, compressed air cylinders. In addition, the invention's design enables the air cylinder to be easily refilled from a standard scuba tank. The inflation source may be filled with air or other harmless gas, e.g. nitrox.

The benefits of a refillable, reusable device should not be discounted. The apparatus of the present invention, once deployed, can easily be re-packed by the freediver, and the cylinder refilled from a scuba tank or other source. These features effectively counter the reluctance of some freedivers to drop their weight belts in an emergency. Many freedivers are reluctant to drop their weight belts, as such action often results in the permanent loss of the weight belt. The weight belts worn by freedivers are often highly customized to suit the individual freedivers' needs and preferences.

For convenience, comfort, and wearability, the compressed air cylinder(s) may be worn in a variety of locations. On the freediver's back would be a primary choice, though chest or abdomen mounting, or even waist or hip mounting are possibilities.

When the device is triggered, compressed air is released from the storage cylinder by the actuator portion and flows into the buoyancy portion of the device. If desired, the cylinder may be mounted at some distance from the buoyancy portion, and connected thereto by a hose or manifold. Such connecting portion may be fitted with quick disconnect fittings to permit ease of disassembly and maintenance.

As an option, provisions can be made for the present invention to incorporate a device which automatically releases the weight belt upon inflation. Various types of release mechanisms could be incorporated into the design to effect this option. Releasable pins, latches, or buckles are all possibilities.

One embodiment of the present invention provides a display which provides the freediver with information pertaining to their current dive and/or their diving profile. This display may be designed to be worn on the wrist like a watch, on the chest or waist, or even in the mask with a "heads-up" type display. Other varieties of monitoring display locations are possible and contemplated as within the scope of the present invention.

Another embodiment of the present invention provides for a configuration that is specifically suited to serve as a useful safety device for apneaists. Freedivers who are engaging in the pursuit of achieving maximum depths or durations, rather than hunting or photographing, have different needs from a safety apparatus. In the case of freedivers who seek to achieve a set maximum depth and return to the surface, the present invention may be configured to allow programming with the desired depth and the estimated time of that depth's attainment and subsequent return to the surface. The apparatus would be programmed to alert the user of a disruption of the expected depth/time curve, and provide emergency inflation. The apparatus could also observe a user's return to the surface and if progress toward the surface slowed or reversed, emergency inflation could be initiated. The implementation of such an embodiment would prove very beneficial and could greatly reduce the risks and costs associated with apnea training.

In order to prevent difficulties resulting from multiple users diving together, and the risk of miscommunication among their safety apparatus, a system of serial numbers, multiple communication frequencies, and "handshaking" recognition protocols may be incorporated. Similarly, to provide for upgrades or replacement of individual components, the apparatus is able to perform a registration process, in order that a particular remote control unit may establish recognition with a particular actuator portion.

BRIEF DESCRIPTION OF THE DRAWINGS

A better understanding of the present invention may be realized from a consideration of the following detailed description, taken in conjunction with the accompanying drawings, in which.

DESCRIPTION OF THE PREFERRED EMBODIMENTS

Figure 1:
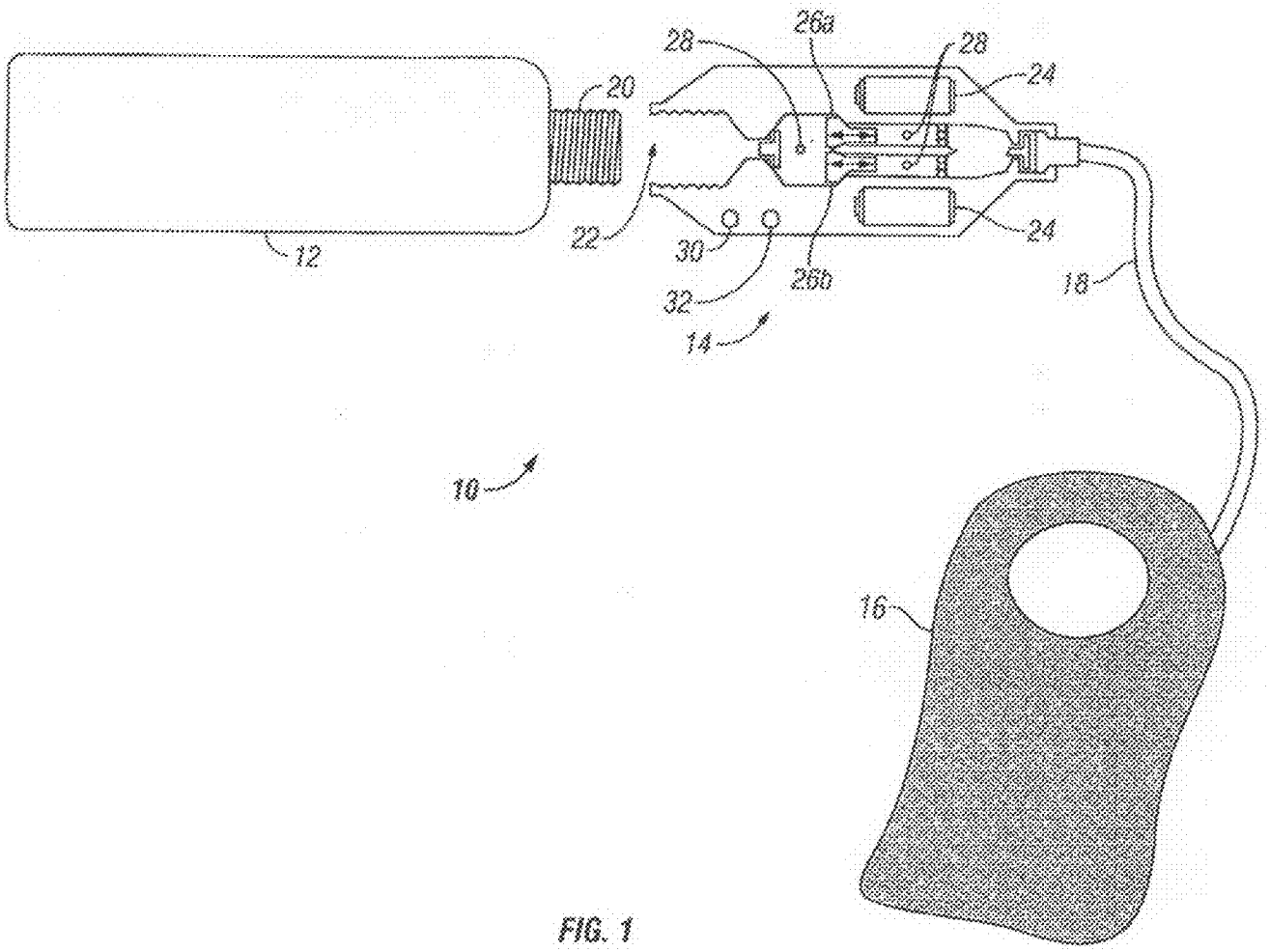
FIG. 1 is a plan view of one particular arrangement in accordance with the invention.

FIG. 1 illustrates a freediving safety apparatus 10 having an inflation source 12, an actuator portion 14, here shown in cross-section, a buoyancy portion 16, and a remotely located control unit (not shown). Flexible hose 18 connects buoyancy portion 16 and actuator portion 14. Inflation source 12 has threaded connection 20 for mounting to threaded receiving port 22 within actuator portion 14. Redundant power supplies, in the form of batteries 24*a* and 24*b*, are mounted within actuator portion 14. Redundant solenoids 26*a* and 26*b* are mounted within actuator portion 14 and serve to affect the release of the compressed gas contents of inflation source 12. Multiple pressure sensors 28*a*, 28*b*, 28*c*, and 28*d*, serve to detect and measure pressure in various chambers within actuator portion 14. Inter-system communication controller 30 transmits sensor data, via radio frequencies, to control unit (not shown). Inter-system communication controller of actuator unit 130 receives radio frequency signals from control unit.

In use, buoyancy portion 16 would be worn about the neck and chest of a freediver, with actuator portion 14 and inflation source 12 mounted in a harness (not shown) and worn on the body, preferably the back. When a control unit detects conditions which required the inflation of the apparatus, for example, maximum depth exceeded, maximum time exceeded, manual deployment activated, or other preprogrammed conditions, then the control unit would signal the actuator unit 14 to activate the primary solenoid 26*a* to release the contents of inflation source 12 through passageways within actuator 14 and through connecting hose 18 to inflate buoyancy portion 16.

Through analysis of data reported by redundant sensors 28*a*, 28*b*, 28*c*, and 28*d*, in the different passageways within actuator portion 14, and others (not shown), the remotely located control unit (not shown) monitors the status of the various components of the apparatus. If control unit detects that, despite commanding actuator portion 14 to inflate buoyancy portion 16, no inflation has occurred, then control unit will command activation of secondary solenoid 26*b* within actuator portion 14 to release the contents of inflation source 12 into buoyancy portion 16.

Figure 2:
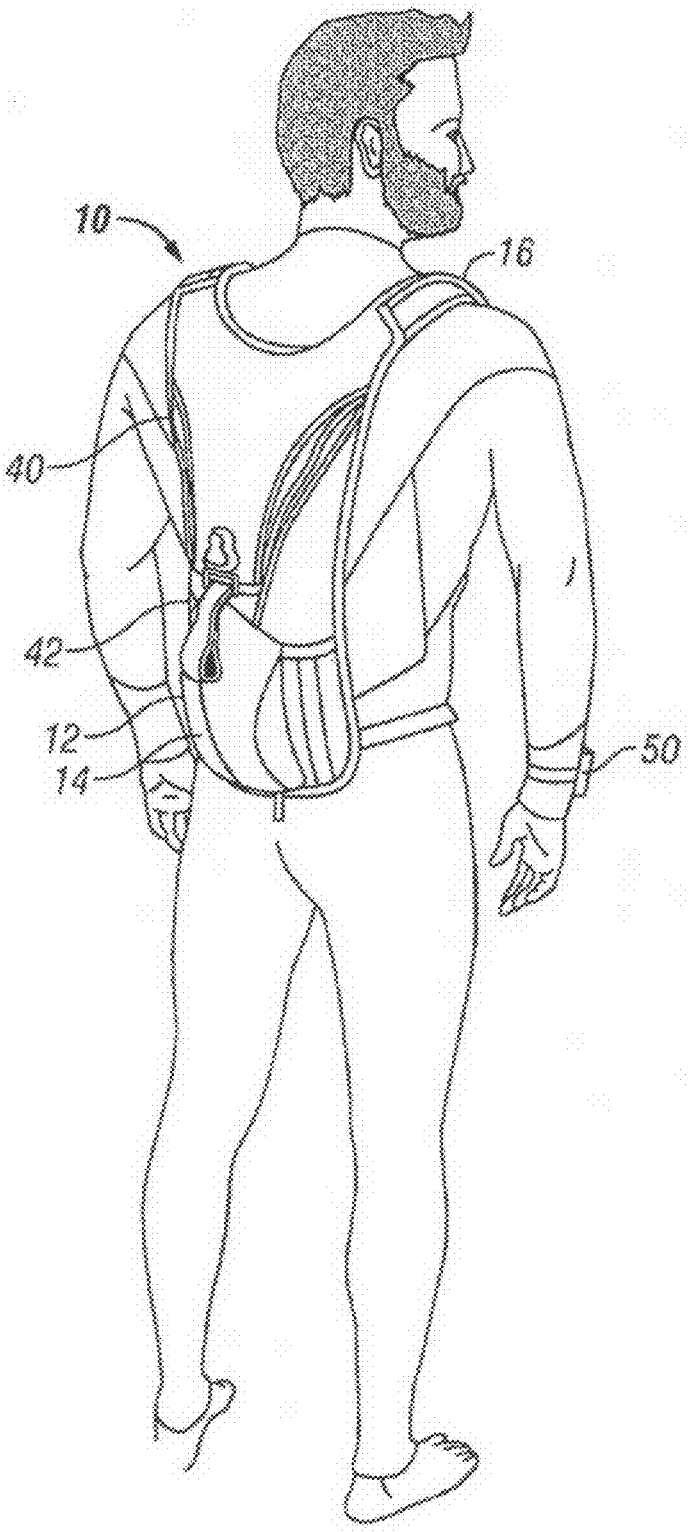
FIG. 2 is a rear quarter view of one particular arrangement in accordance with the invention, depicted on a human figure.

FIG. 2 illustrates a rear quarter view of one embodiment of a freediving safety apparatus 10, depicted being worn by a human figure. The inflation source 12, actuator portion 14, and buoyancy portion 16 are contained within the wearable garment 40. Access panel 42, formed in garment 40, provides ready access to inflation source 12 and actuator portion 14, for inspection and maintenance. Control unit 50 may be wrist-mounted (as shown) or otherwise remotely located, and communicates with actuator portion 14 using radio frequency or other means for communication, preferably wireless.

Figure 3:
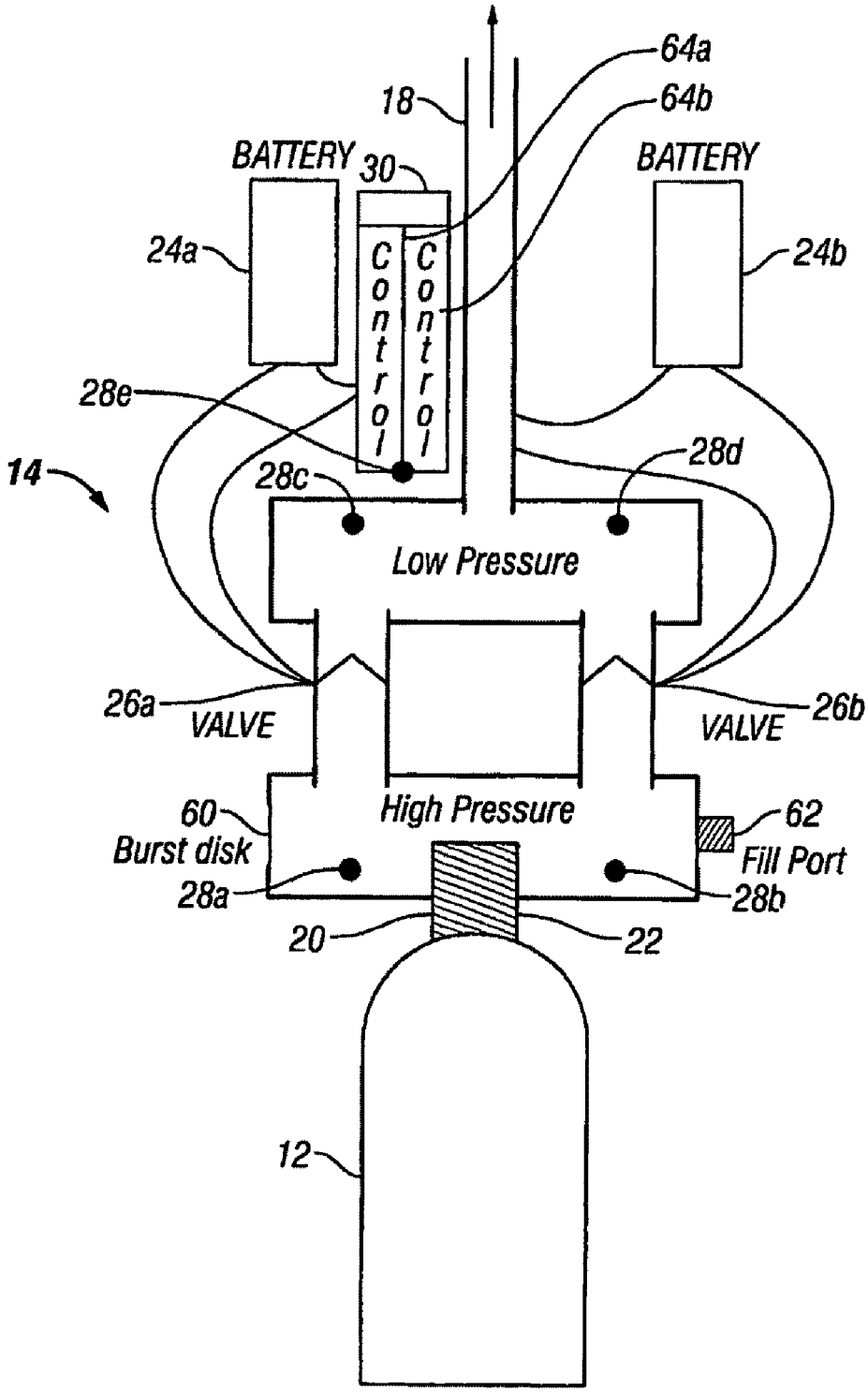
FIG. 3 is a plan view of one particular arrangement of an inflation source and an actuator portion in accordance with the invention.

FIG. 3 illustrates another embodiment of an inflation source 12 and an actuator portion 14 in accordance with the present invention. Inflation source 12 is connected to actuator portion 14. Actuator portion 14 is equipped with a burst disk 60 or comparable device to release pressure from the inflation source in the event of dangerous over-pressurization. Fill port 62 is provided to enable convenient refilling of the inflation source 12. Fill port 62 may be adapted to provide convenient refilling of inflation source 12 through the use of common scuba tanks.

Additional sensor 28*e* provides data reflecting external pressure, i.e., depth. Redundant actuator control processors 64*a* and 64*b* manage data and logic processing and memory for monitoring and operation of actuator functions. Redundant actuator control processors 64*a* and 64*b* are capable of receiving programming and data transfer and other communications with remote control unit 50, through use of inter-system communication controller 30. Such communications are preferably wireless.

Redundant function capability is preferably incorporated into the design of the present invention, through the implementation of redundant power sources 24*a* and 24*b*, which are preferably conveniently replaceable batteries. Redundancy may be provided throughout the actuator unit 14, including: high pressure sensors 28*a* and 28*b* for sensing pressure level of inflation source 12, low pressure sensors 28*c* and 28*d* for sensing and detecting effective release of contents of inflation source 12, valves 26*a* and 26*b* for controlling the release of pressurized contents of inflation source 12.

Inflation source 12 connects to actuator portion 14 through threaded portion 20 on inflation source 12, which attaches to threaded receptacle 22 formed in actuator portion 14.

Figure 4:
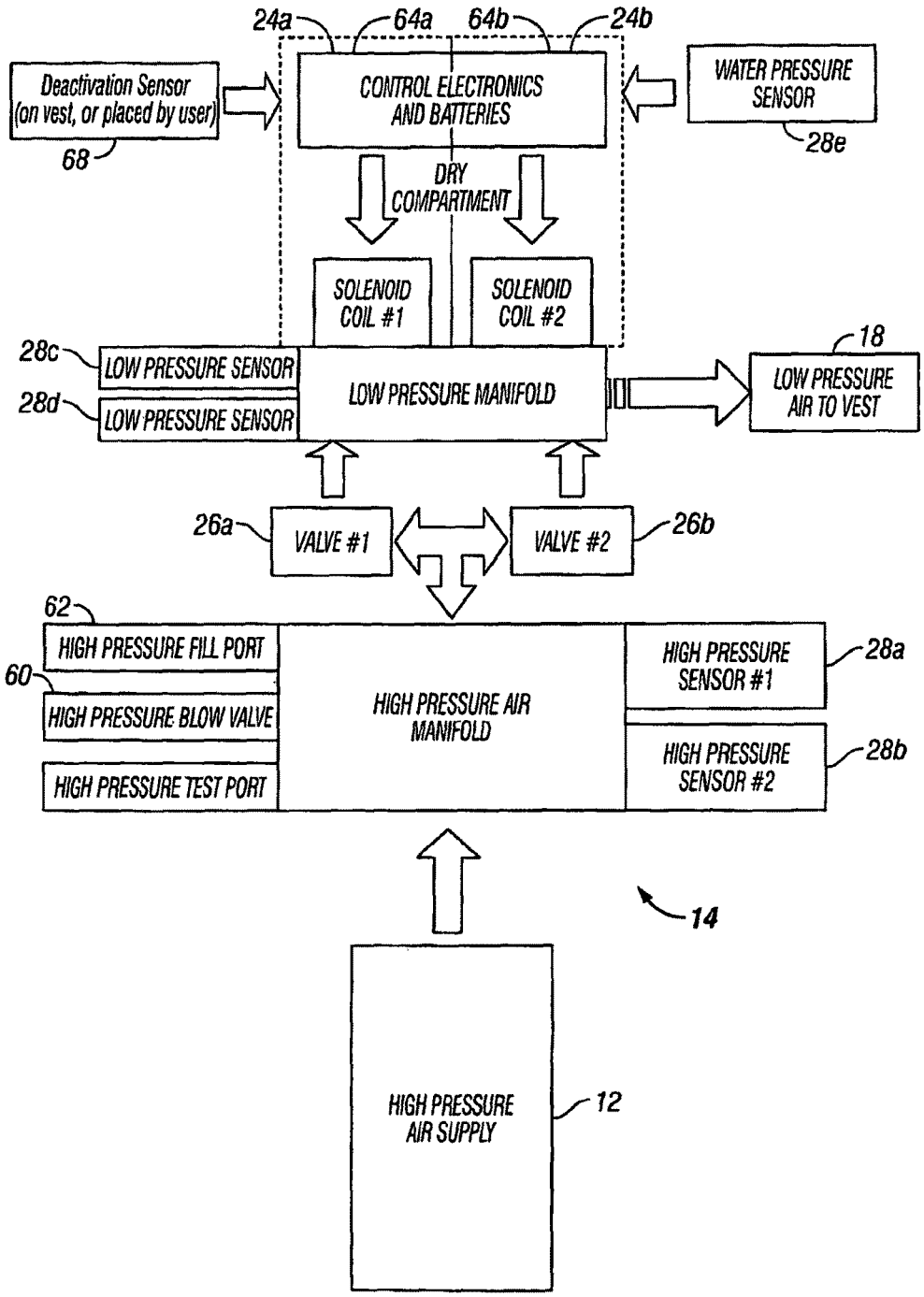
FIG. 4 is a block diagram of one particular arrangement of an inflation source and actuator portion in accordance with the invention.

FIG. 4 illustrates the relation of various components to another embodiment of actuator portion 14. Redundant power sources 24*a* and 24*b* provide electrical energy required to operate actuator unit 14. Along with other redundant components, including redundant control processors 64*a* and 64*b*, redundant valves 26*a* and 26*b*, redundant high pressure sensors 28*a* and 28*b*, redundant low pressure sensors 28*c* and 28*d*, the actuator portion 14 provides a level of performance redundancy by isolating each redundant system from the other. Even if one system fails, the other redundant system will allow actuator portion 14 to function as anticipated.

In order to enable a user to disable the apparatus at the end of a current dive, and prepare it for a subsequent dive, a deactivation sensor 68 is provided to signal actuator control processors 64*a* and 64*b*. Deactivation sensor 68 operates in concert with disable trigger 104 (not shown) incorporated in remotely locatable control unit 50. Upon resurfacing 82 following a dive a user is required to bring the disable trigger 104 in close proximity to deactivation sensor 68, in order to signal 84 that the user is conscious and functioning at the end of the dive. Deactivation sensor 68 may consist of other mechanical or electrical sensors, signals or switches known to persons skilled in the art. The magnetic deactivation sensor 68 of the present invention is beneficial in that it allows a user to locate or mount the deactivation sensor 68 in a location of their choosing. The control unit 50 will communicate the activation 84 of disable trigger 104 to actuator portion 14 in order to affect a reset 96 of the apparatus.

Figure 9:
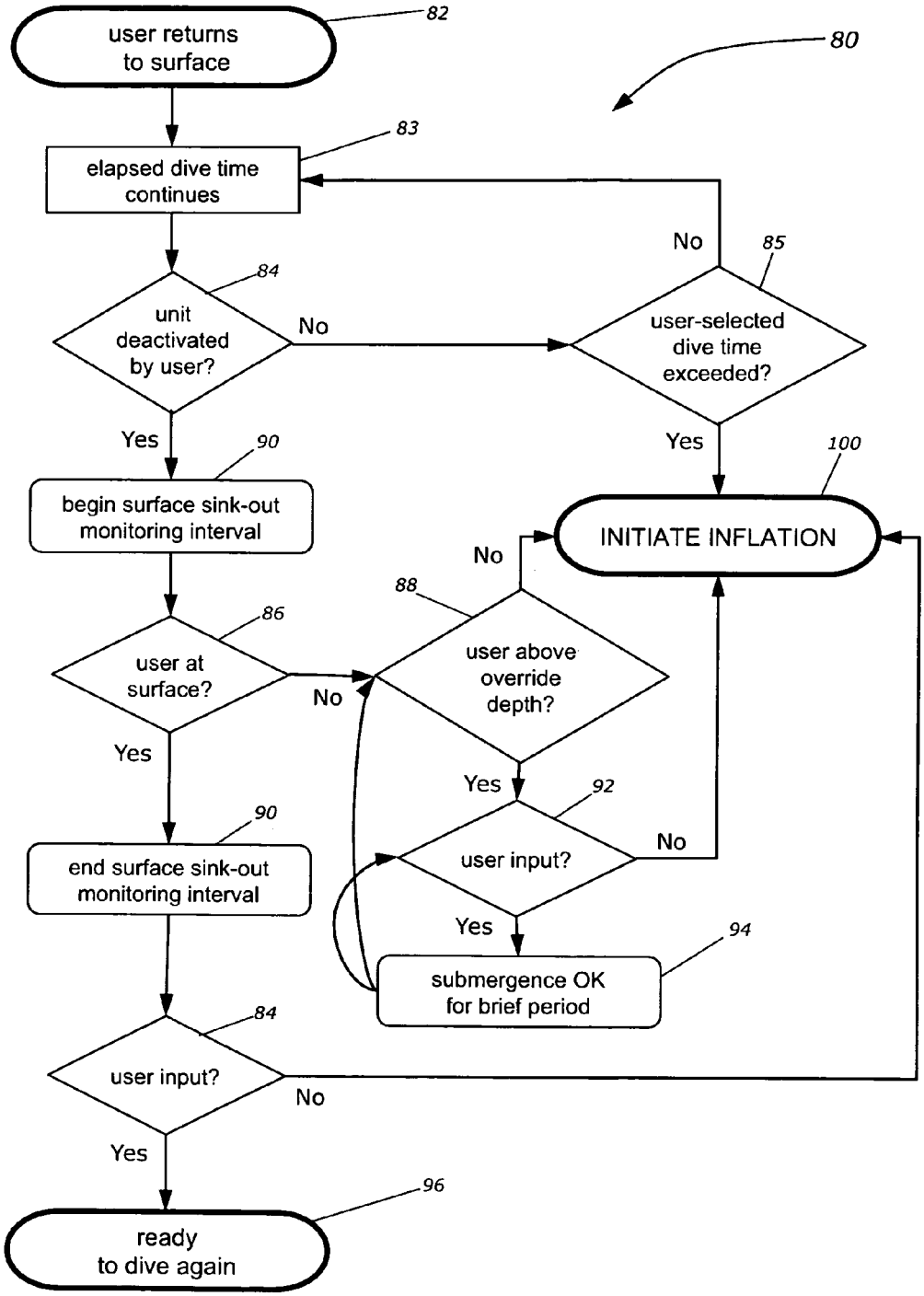
FIG. 9 is a block diagram flow chart of logic for a surface sink-out protective feature in accordance with the present invention.

FIG. 9 is a block diagram flow chart of logic for surface sink-out protection in accordance with the present invention. If a user reaches the surface 82 following a dive and is able to disable 84 the apparatus using the disable trigger 104 and deactivation sensor 68, without exceeding 85 the time value 83 for triggering inflation 100, it is still possible for that user to blackout. The surface sink-out protective logic 80 programmed in the apparatus may be configured to initiate emergency inflation 100 if a user submerges 86 below a predetermined depth 88 within a relatively brief period 90 after reaching the surface. In the unusual event of a situation requiring a user to immediately dive again upon reaching the surface, e.g. a boat bearing down on them, a selecting 92 of certain buttons on control unit 50 (not shown) may provide for a temporary override 94 of this feature.

Figure 5:
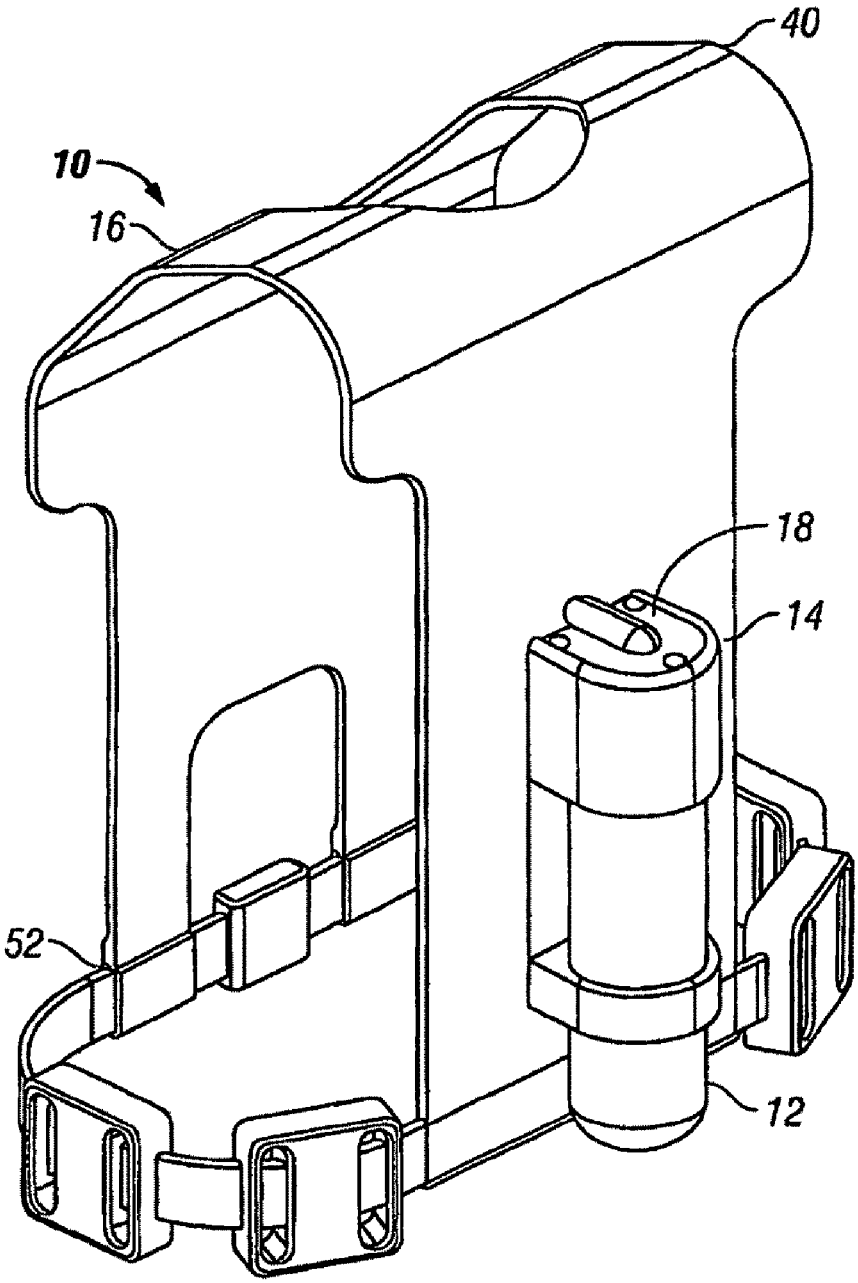
FIG. 5 is a rear quarter view of one particular arrangement of an inflation source, actuator portion, buoyancy portion, and harness, in accordance with the invention, depicted in combination with a freediver's weight belt.

FIG. 5 illustrates a basic apparatus in accordance with the present invention. Inflation source 12, attached to actuator portion 14, is affixed to harness 52 which is partially or completely covered by garment 40. Access panel 42 (not shown) may be provided to enable inspection, removal, or refilling of actuator portion 14 or other components. Access panel 42 may be configured as a compartment, pocket, or sleeve feature of garment 40 or harness 52.

Buoyancy portion 16 is retained by harness 52 or garment 40 to reduce drag while swimming. Secure linkage or attachment of buoyancy portion 16 to harness 52 may be provided by straps, clips or other linking or attaching means. Garment 40 permits buoyancy portion 16 during inflation, through expansion or release. Connection hose 18 allows released air from actuator portion 14 to pass into buoyancy portion 16 to cause inflation. Connection hose 18 may incorporate quick disconnect fittings and utilize flexible materials to facilitate maintenance and component placement. Alternately, actuator portion 14 may provide direct connection to buoyancy portion 16, thereby allowing direct passage of gas from inflation source 12.

An automatic release mechanism may be incorporated into the apparatus, preferably into harness 52, to enable the actuator portion 14 to automatically ditch the user's weight belt in emergency inflation conditions.

Figure 6:
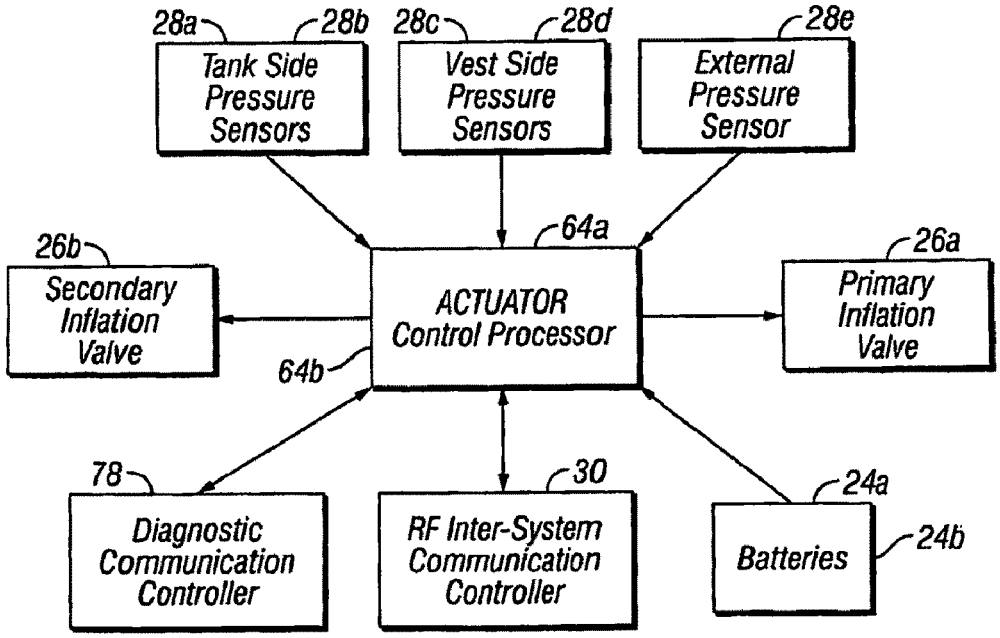
FIG. 6 is a communications block diagram of one particular arrangement of an actuator portion in accordance with the present invention.

FIG. 6 depicts a block diagram flow chart of information and data communication of an actuator portion 14 in accordance with the present invention. Control processors 64*a* and 64*b* receive data of inflation source 12 pressure from high pressure sensors 28*a* and 28*b*, data of buoyancy portion 16 pressure from low pressure sensors 28*c* and 28*d*, and relative depth information from external pressure sensor 28*e*. Batteries 24*a* and 24*b* provide necessary electrical power for the system. Diagnostic communications controller 78 enables programming and communication with actuator portion 14. Controller 78 is preferably a convenient computer connection or port, such as USB, but may be wireless, e.g., Bluetooth. The manufacturer, dealer, service center, or a user may utilize diagnostic communications controller 78 for additional programming of the apparatus for system updates; provide for initial configuration and set up; allow customization through additional optional features or functions of the apparatus which may be provided; allow diagnostic information to be retrieved; provide detailed reports of stored data to be downloaded and viewed or charted using a computer.

Control processors 64*a* and 64*b* monitor data from sensors and perform comparisons to predetermined values selected by a user. Logic commands 80 programmed and stored in control processors 64*a* and 64*b* allow recognition of predetermined circumstances requiring emergency inflation, and initiate activation of inflation valve 26*a*. If sensors do not reflect the successful opening of valve 26*a* and subsequent release of compressed gas from inflation source 12, control processors 64*a* and 64*b* initiate activation of valve 26*b*. Communication with control unit 50 is provided by inter-system communication controller 30, which establishes communications with corresponding actuator unit inter-system communication controller 130.

Figure 7:
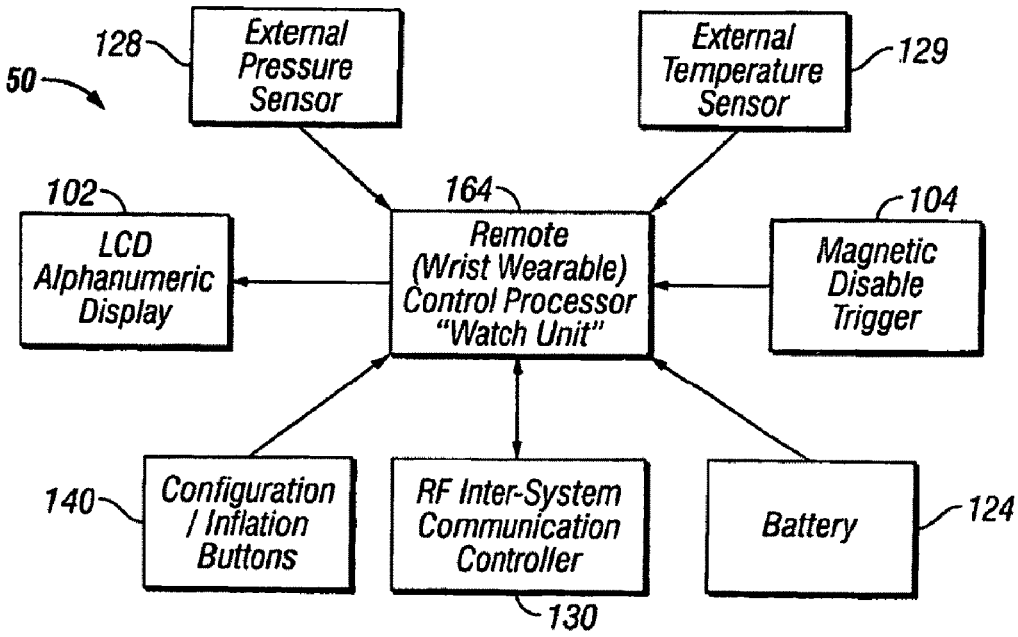
FIG. 7 is a communications block diagram of one particular arrangement of a remotely locatable control unit in accordance with the present invention.

FIG. 7 depicts a block diagram flow chart of information and data communication of a control unit 50 in accordance with the present invention. Control unit 50 is remotely mountable by a user, and is preferably worn "watch style" on the wrist or arm of a user. Control processor 164 receives data of external or water temperature from sensor 129; data of external pressure or depth from sensor 128; and communicates with inter-system communication controller 30 of actuator unit 14 by communication controller 130.

A display 102, preferably LCD alphanumeric, provides a means for control unit 50 to provide a user with information (current or historical), allows interaction with the control unit 50, and also may be used to alert a user through visual signals. Control unit 50 allows a user to select, or enter, values for configuring the apparatus and programming the values that will be used to determine the occurrence of emergency conditions requiring inflation. This may be achieved through buttons 140, or other interface means that enable a user to enter data or select values related to the operation or configuration of the apparatus. A battery 124 provides power for the operation of control unit 50. Control unit 50 also provides a means for disabling the actuator device 14. Preferably, this is achieved by a magnetic disable trigger 104 provided by control unit 50.

Figure 8:
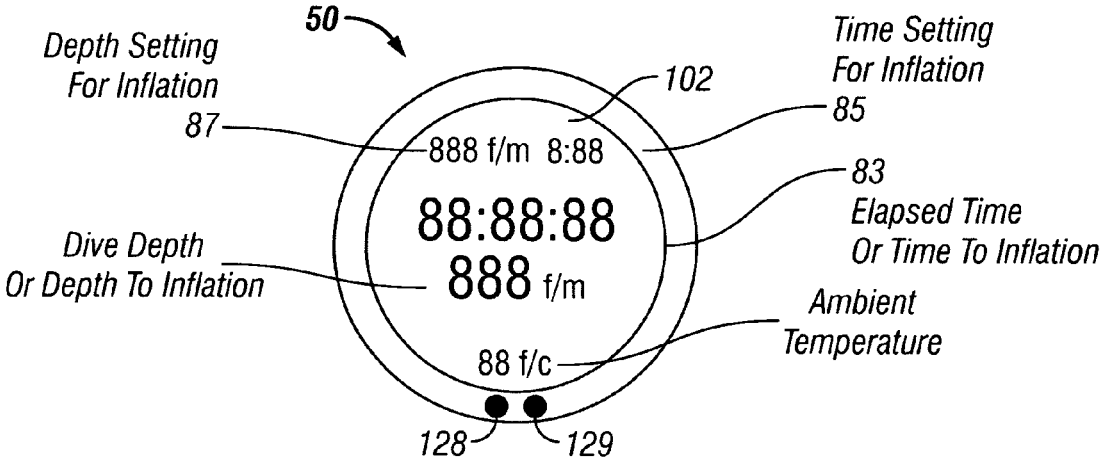
FIG. 8 is a plan view of the display portion of a remotely locatable control unit in accordance with the present invention.

FIG. 8 depicts a top plan view of control unit 50, showing sample characters represented upon display 102. Such a display 102 is preferably an LCD device, providing excellent resolution and pixel selection. Exemplary data values that might be displayed could include a user's preselected depth value 87 and time value 85 for triggering inflation 100; time elapsed during a current dive 83—which could change to display a counting down of time to inflation as the "trigger" time (user-selected dive time) 85 approaches; current or maximum dive depth—which could change to display a counting down of depth to inflation as the "trigger" depth (user-selected maximum depth) 87 approaches; water or ambient temperature. Pressure sensor 128 provides data related to depth values, while temperature sensor 129 provides for temperature readings on display 102. Data values for depth, temperature and time are recorded at predetermined intervals and stored for subsequent retrieval by a user or others. Sufficient memory is provided to enable storage of data sampled each second of a dive, for several days of diving. After passage of a predetermined period of time, for example 15 minutes, following returning to the surface, control unit directs display 102 to revert to displaying usual watch values. Time of day, day of month, month and year, along with other desirable values may be displayed.

Although there have been described hereinabove various specific arrangements of a FREEDIVING SAFETY APPARATUS in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. Freediving safety apparatus for transport by a freediver user during an underwater dive, said apparatus comprising:

a refillable inflation source in the form of a container for carrying a supply of compressed gas;

a buoyancy portion in the form of a flotation device coupled to said container for inflation from said container upon the occurrence of one or more selected events;

a plurality of sensors which are individually responsive to the occurrence of corresponding ones of said selected events;

at least one valve coupled between said container and said flotation device for controlling the transfer of gas to said flotation device, said at least one valve being responsive to an activating signal; and a control unit in operable communication with said sensors and said valve, said control unit issuing said activating signal in response to a sensor signaling the occurrence of one of said selected events, in order to inflate said flotation device to bring the freediver to a surface of a body of water in a face up position;

wherein said control unit further comprises internal polling to detect malfunction of said apparatus and consequently prevent use of the apparatus.

2. Freediving safety apparatus for transport by a freediver user during an underwater dive, said apparatus comprising:

a refillable inflation source in the form of a container for carrying a supply of compressed gas;

a buoyancy portion in the form of a flotation device coupled to said container for inflation from said container upon the occurrence of one or more selected events;

a plurality of sensors which are individually responsive to the occurrence of corresponding ones of said selected events;

at least one valve coupled between said container and said flotation device for controlling the transfer of gas to said flotation device, said at least one valve being responsive to an activating signal; and a control unit in operable communication with said sensors and said valve, said control unit issuing said activating signal in response to a sensor signaling the occurrence of one of said selected events, in order to inflate said flotation device to bring the freediver to a surface of a body of water in a face up position;

wherein said control unit further comprises logic programmed for said control processors, whereby a user, following completion of a dive and deactivation of said apparatus, must remain above a programmed depth value for a programmed time value, in order to establish continued consciousness and avoid initiating inflation of said apparatus.

3. Freediving safety apparatus for transport by a freediver user during an underwater dive, said apparatus comprising:

a refillable inflation source in the form of a container for carrying a supply of compressed gas;

a buoyancy portion in the form of a flotation device coupled to said container for inflation from said container upon the occurrence of one or more selected events;

a plurality of sensors which are individually responsive to the occurrence of corresponding ones of said selected events;

at least one valve coupled between said container and said flotation device for controlling the transfer of gas to said flotation device, said at least one valve being responsive to an activating signal; and a control unit in operable communication with said sensors and said valve, said control unit issuing said activating signal in response to a sensor signaling the occurrence of one of said selected events, in order to inflate said flotation device to bring the freediver to a surface of a body of water in a face up position;

wherein said control unit further comprises a premature disarming feature wherein a user is prevented from disarming the apparatus prior to returning to a surface of a body of water.

4. Freediving safety apparatus for transport by a freediver user during an underwater dive, said apparatus comprising:

a refillable inflation source in the form of a container for carrying a supply of compressed gas;

a buoyancy portion in the form of a flotation device coupled to said container for inflation from said container upon the occurrence of one or more selected events;

a plurality of sensors which are individually responsive to the occurrence of corresponding ones of said selected events;

at least one valve coupled between said container and said flotation device for controlling the transfer of gas to said flotation device, said at least one valve being responsive to an activating signal; and a control unit in operable communication with said sensors and said valve, said control unit issuing said activating signal in response to a sensor signaling the occurrence of one of said selected events, in order to inflate said flotation device to bring the freediver to a surface of a body of water in a face up position;

wherein said control unit further comprises a surface sink-out protective feature logic programmed for said control processors, whereby a user, following completion of a dive and deactivation of said apparatus, must remain above a programmed depth value for a programmed time value, in order to establish continued consciousness and avoid initiating inflation of said apparatus;

wherein said logic programmed for said control processors includes a temporary override feature, whereby a user responding to an unusual event may provide input to said control unit to provide a temporary override of initiating inflation of said apparatus.

5. Freediving safety apparatus for transport by a freediver user during an underwater dive, said apparatus comprising:

a refillable inflation source in the form of a container for carrying a supply of compressed gas;

a buoyancy portion in the form of a flotation device coupled to said container for inflation from said container upon the occurrence of one or more selected events;

a plurality of sensors which are individually responsive to the occurrence of corresponding ones of said selected events;

at least one valve coupled between said container and said flotation device for controlling the transfer of gas to said flotation device, said at least one valve being responsive to an activating signal; and a control unit in operable communication with said sensors and said valve, said control unit issuing said activating signal in response to a sensor signaling the occurrence of one of said selected events, in order to inflate said flotation device to bring the freediver to a surface of a body of water in a face up position;

further including a system for providing a user with inflation of said buoyancy portion in response to sensor data signaling the occurrence of one of said selected events, comprising:

(a) control processor for receiving output signals from said sensors, comparing said sensor output values with user-selected and programmed values and processing data;

(b) memory for storing data;

(c) programmed logic for:

(i) monitoring selected senor signals during user dives to detect occurrence of one of programmed circumstances or user-selected events requiring inflation initiation;

(ii) initiating inflation of said apparatus upon detection of occurrence of one of programmed circumstances or user-selected events;

(iii) identifying sensor output representing a user returned to surface;

(iv) detecting deactivation command by user prior to expiration of user-selected dive time elapsed and initiating a period of time after reaching a surface of a body of water in response thereto;

(v) monitoring external pressure sensor signals during said period of time after reaching the surface and initiating inflation upon detection of submergence below a programmed depth.

6. The freediving safety apparatus of claim 5, further comprising programmed logic for:

(a) initiating inflation upon detecting user failure to provide deactivation signal upon expiration of said period of time after reaching the surface;

(b) detecting deactivation signal by a user prior to expiration of said period of time after reaching the surface and producing a reset of said apparatus for repeat use.

7. The freediving safety apparatus of claim 5, further comprising programmed logic for:

(a) detecting deactivation signal by a user in association with submergence during said period of time after reaching the surface;

(b) comparing user depth values to a programmed override depth value and initiating inflation if user depth values exceed a programmed override depth value and otherwise permitting temporary override of inflation initiation.

8. A freediving safety device wearable by a user engaging in freediving, for providing buoyancy under programmed circumstances, said apparatus comprising:

a refillable inflation source for containing compressed gas;

a buoyancy portion having an inflatable portion operably connected for receiving the contents of said inflation source;

an actuator portion disposed between said inflation source and said buoyancy portion for transferring contents from said inflation source to said buoyancy portion, a plurality of sensors for providing signals representing selected parameters, a control unit in operable communication with said actuator portion:

a) for input of user-selected data values defining emergency buoyancy circumstances, b) for recognizing occurrences of user-defined emergency buoyancy circumstances, and c) for allowing user interaction under defined circumstances;

at least one power supply in operable communication with said actuator portion and said control unit, and a wearable harness, providing secure retention of said apparatus when worn by a user;

further comprising at least one communication controller for communications of said actuator portion and said control unit.

* * * * *